US011817058B2

(12) United States Patent
Hong et al.

(10) Patent No.: US 11,817,058 B2
(45) Date of Patent: Nov. 14, 2023

(54) LIGHT EMITTING DISPLAY DEVICE AND METHOD OF DRIVING THE SAME

(71) Applicant: LG Display Co., Ltd., Seoul (KR)

(72) Inventors: Yo Han Hong, Paju-si (KR); Kyung Rok Kim, Paju-si (KR); Dong Kyu Woo, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/559,509

(22) Filed: Dec. 22, 2021

(65) Prior Publication Data

US 2022/0208126 A1 Jun. 30, 2022

(30) Foreign Application Priority Data

Dec. 29, 2020 (KR) ..... 10-2020-0186538

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2310/0294* (2013.01); *G09G 2320/0295* (2013.01); *G09G 2320/045* (2013.01)

(58) Field of Classification Search
CPC ..... G09G 3/3275; G09G 3/3233; G09G 2310/0294; G09G 2320/0295; G09G 2320/045; G09G 2300/0426; G09G 3/3258; G09G 3/3266; G09G 2320/0693; G09G 3/3208; G09G 3/32; G09G 2320/043; G09G 2300/0842
See application file for complete search history.

(56) References Cited

U.S. PATENT DOCUMENTS 5,627,457 A * 5/1997 Ishiyama ..... G09G 3/3696 345/94
5,760,757 A * 6/1998 Tanaka ..... G09G 3/3622 345/93
6,972,747 B2 * 12/2005 Bayot ..... G09G 3/3648 345/55
7,919,975 B2 * 4/2011 Ryu ..... G09G 5/006 324/760.01
8,115,505 B2 * 2/2012 Ryu ..... G09G 5/006 324/629
8,279,206 B2 * 10/2012 Ryu ..... H03K 17/687 326/86
8,547,321 B2 * 10/2013 Smith ..... G09G 3/342 345/95

(Continued)

FOREIGN PATENT DOCUMENTS

KR 10-2015-0015646 A 2/2015
KR 10-2018-0057285 A 5/2018

(Continued)

*Primary Examiner* — Michael J Jansen, II
(74) *Attorney, Agent, or Firm* — Fenwick & West LLP

(57) ABSTRACT

A light emitting display device includes a display panel configured to display an image, a data driver configured to supply a data voltage to data lines of the display panel, and a sensing circuit configured to obtain a sensing voltage through sensing lines of the display panel after reflecting a negative impedance value canceling impedance differences of the sensing lines.

20 Claims, 20 Drawing Sheets

(56) References Cited

U.S. PATENT DOCUMENTS 8,618,866 B2 * 12/2013 Fung ..... G11C 5/147 327/530
9,336,717 B2 * 5/2016 Chaji ..... G09G 3/3233
9,349,311 B2 * 5/2016 Yu ..... G09G 3/3291
9,424,781 B2 * 8/2016 Park ..... G09G 3/3291
9,819,991 B1 * 11/2017 Rajagopalan ..... G09G 5/006
9,983,604 B2 * 5/2018 Lee ..... G05F 1/575
10,032,409 B1 * 7/2018 Wu ..... G09G 3/3233
10,102,798 B2 * 10/2018 Song ..... G09G 3/3225
10,249,248 B2 * 4/2019 Lee ..... G09G 3/3233
10,324,573 B2 * 6/2019 Chang ..... G09G 3/2092
10,380,942 B2 * 8/2019 An ..... G09G 3/3233
10,504,391 B2 * 12/2019 Lim ..... G09G 3/3291
10,522,077 B2 * 12/2019 Woo ..... G09G 3/3291
10,565,908 B2 * 2/2020 Lee ..... G09G 3/3266
10,573,211 B2 * 2/2020 Lin ..... G09G 3/3648
10,580,356 B2 * 3/2020 An ..... G09G 3/3233
10,741,146 B2 * 8/2020 Song ..... G09G 5/10
10,748,490 B2 * 8/2020 Xu ..... G09G 3/3258
10,755,618 B2 * 8/2020 Lin ..... G09G 3/20
10,825,386 B2 * 11/2020 Yan ..... G09G 3/2011
11,016,608 B2 * 5/2021 Chen ..... G09G 3/3696
11,030,951 B2 * 6/2021 Lee ..... G09G 3/3233
11,094,265 B2 * 8/2021 Kato ..... H01L 27/3218
11,107,397 B2 * 8/2021 Sung ..... G09G 3/3225
11,107,420 B2 * 8/2021 Hong ..... G09G 3/3258
11,127,359 B2 * 9/2021 Yuan ..... G09G 3/3291
11,282,426 B2 * 3/2022 Park ..... G09G 3/20
11,282,456 B2 * 3/2022 Piao ..... G09G 3/3241
2003/0030630 A1 * 2/2003 Bayot ..... G09G 3/20 345/204
2006/0244512 A1 * 11/2006 Fung ..... G11C 5/147 327/530
2008/0170052 A1 * 7/2008 Ryu ..... G09G 3/3688 345/204
2008/0238442 A1 * 10/2008 Ryu ..... G09G 5/006 324/629
2008/0238443 A1 * 10/2008 Ryu ..... G09G 3/006 324/629
2010/0020004 A1 * 1/2010 Smith ..... G09G 3/342 345/102
2010/0085343 A1 * 4/2010 Yamada ..... G09G 3/344 345/107
2014/0300281 A1 * 10/2014 Chaji ..... G09G 3/3233 315/161
2015/0379909 A1 * 12/2015 Yu ..... G09G 3/006 345/78
2016/0071464 A1 * 3/2016 Park ..... G09G 3/3291 345/212
2017/0053590 A1 * 2/2017 Song ..... G09G 3/32
2017/0097649 A1 * 4/2017 Lee ..... G09G 3/3696
2017/0154573 A1 * 6/2017 Woo ..... G09G 3/3266
2017/0249882 A1 * 8/2017 Lee ..... G09G 3/3233
2018/0122364 A1 * 5/2018 Lim ..... G09G 3/3225
2018/0137819 A1 * 5/2018 An ..... G09G 3/3233
2018/0144689 A1 * 5/2018 Hong ..... G09G 3/3275
2018/0166515 A1 * 6/2018 An ..... G09G 3/3291
2018/0174522 A1 * 6/2018 Lee ..... G09G 3/3291
2018/0181230 A1 * 6/2018 Chang ..... G06F 3/04166
2018/0197468 A1 * 7/2018 Wu ..... G09G 3/3225
2019/0221146 A1 * 7/2019 Lin ..... G09G 3/3648
2019/0244555 A1 * 8/2019 Lin ..... G09G 3/006
2019/0317350 A1 * 10/2019 Horibe ..... G09G 3/3685
2019/0385519 A1 * 12/2019 Yan ..... G09G 3/2011
2019/0385568 A1 * 12/2019 Song ..... G09G 3/3291
2020/0074927 A1 * 3/2020 Xu ..... G09G 3/3233
2020/0152121 A1 * 5/2020 Sung ..... H02M 3/158
2020/0202777 A1 * 6/2020 Lee ..... G09G 3/3233
2020/0218422 A1 * 7/2020 Chen ..... G09G 3/3648
2020/0302878 A1 * 9/2020 Kato ..... G02F 1/136286
2020/0357320 A1 * 11/2020 Park ..... G09G 3/20
2021/0065627 A1 * 3/2021 Chou ..... G09G 3/3291
2021/0125568 A1 * 4/2021 Yuan ..... G09G 3/3266
2021/0193039 A1 * 6/2021 Piao ..... G09G 3/3291

FOREIGN PATENT DOCUMENTS

KR 10-2018-0059189 A 6/2018
KR 10-2018-0068175 A 6/2018

* cited by examiner

LIGHT EMITTING DISPLAY DEVICE AND METHOD OF DRIVING THE SAME

CROSS-REFERENCE TO RELATED APPLICATION

This application claims the benefit of Republic of Korea Patent Application No. 10-2020-0186538, filed on Dec. 29, 2020, which is hereby incorporated by reference in its entirety.

BACKGROUND

Field of Technology

The present disclosure relates to a light emitting display device and a method of driving the same.

Discussion of the Related Art

The development of information technology has brought the growth of the market for display devices, which are a connection medium between users and information. Accordingly, display devices such as a light emitting display (LED) device, a quantum dot display (QDD) device, and a liquid crystal display (LCD) device are increasingly used.

Such a display device includes a display panel including sub-pixels, a driver that outputs a driving signal for driving the display panel, and a power supply that generates power to be supplied to the display panel or the driver.

In the display device, upon application of a driving signal, for example, a scan signal and a data signal to sub-pixels on the display panel, the selected sub-pixels transmit light or directly emit light, thereby displaying an image.

Among the above-described display devices, a light emitting display device advantageously has mechanical features such as flexible implementation as well as electric and optical features such as fast response, high brightness, and a wide viewing angle. However, the light emitting display device is yet to be further improved and thus requires continuous research.

SUMMARY

Accordingly, the present disclosure is directed to a light emitting display device and a method of driving the same that substantially obviate one or more problems due to limitations and disadvantages of the related art.

The present disclosure is intended to increase sensing accuracy by compensating for deviations and variations between sensing lines through impedance calibration and to increase the performance and lifetime of a display panel by fast detecting and compensating a sensing voltage.

Additional advantages, objects, and features of the invention will be set forth in part in the description which follows and in part will become apparent to those having ordinary skill in the art upon examination of the following or may be learned from practice of the invention. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a light emitting display device includes a display panel configured to display an image, the display panel including sensing lines; a data driver configured to supply a data voltage to data lines of the display panel; and a sensing circuit configured to obtain a sensing voltage through the sensing lines of the display panel after reflecting a negative impedance value on the sensing lines, the negative impedance value canceling impedance differences between the sensing lines.

In one embodiment, a method of driving a light emitting display device, the method comprises: while a display panel configured to display an image is turned off, generating a negative impedance value that cancels impedance differences between sensing lines of the display panel; while the display panel is turned on, obtaining a sensing voltage through the sensing lines after reflecting the negative impedance value to the sensing lines; and compensating the display panel based on the sensing voltage.

In one embodiment, a light emitting display device comprises: a display panel including a plurality of pixels, a plurality of sensing lines, and a plurality of data lines, each of the plurality of sensing lines and each of the plurality of data lines connected to a corresponding one of the plurality of pixels; a data driver configured to supply data voltages to the plurality of pixels, each of the data voltages supplied to a corresponding one of the plurality of pixels via one of the plurality of data lines that is connected to the corresponding one of the plurality of pixels; and a deviation calibrator configured to determine impedance differences between the plurality of sensing lines and generate negative impedance values for the plurality of sensing lines based on the determined impedance differences, wherein resistances of the plurality of sensing lines are changed based on the negative impedance values to cancel the impedance differences between the plurality of sensing lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
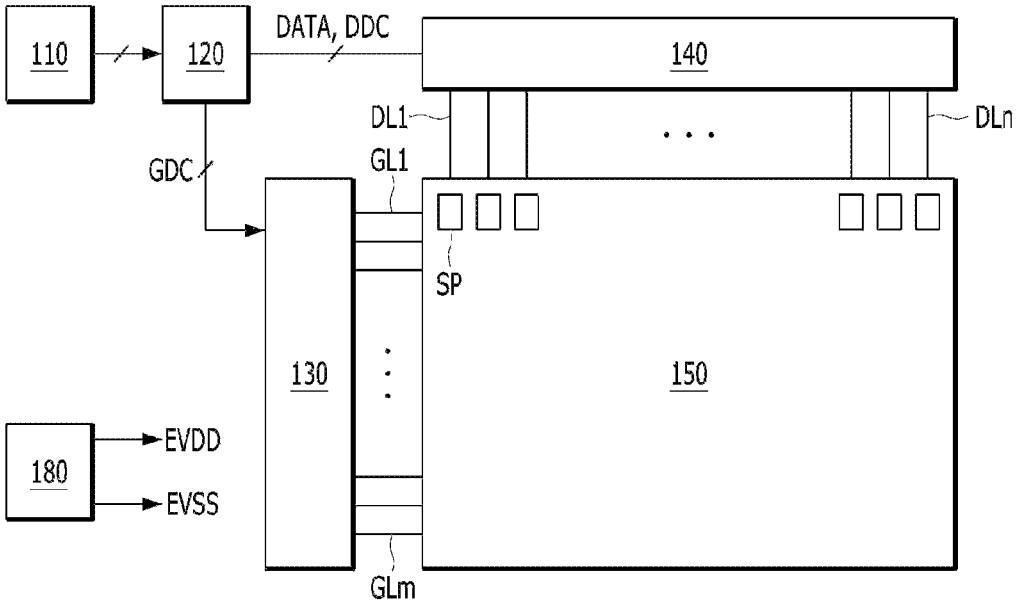
FIG. 1 is a block diagram illustrating a light emitting display device according to one embodiment.
Figure 2:
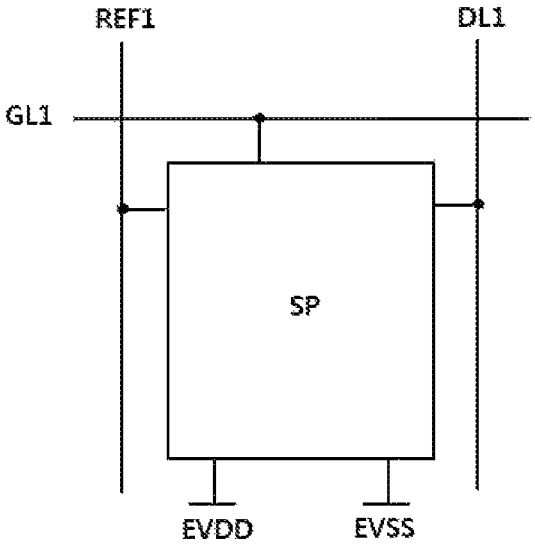
FIG. 2 is a diagram illustrating the configuration of a sub-pixel included in a display panel according to one embodiment.
Figure 3:
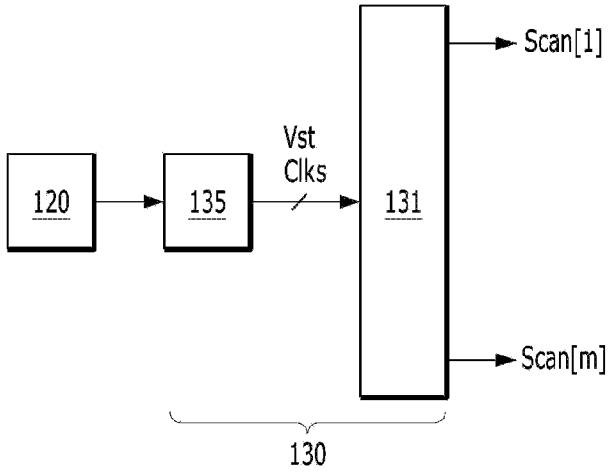
FIG. 3 is a diagram illustrating the configuration of a device related to a gate-in-panel (GIP) scan driver according to one embodiment.

FIG. 1 is a block diagram illustrating a light emitting display device, FIG. 2 is a diagram illustrating the configuration of a sub-pixel included in a display panel, FIG. 3 is a diagram illustrating the configuration of a device related to a gate-in-panel (GIP) scan driver, and FIG. 4 is a diagram illustrating exemplary layouts of the GIP scan driver, according to one embodiment.

Referring to FIGS. 1 to 4, the light emitting display device may include an image supply 110, a timing controller 120, a scan driver 130, a data driver 140, a display panel 150, and a power supply 180.

The image supply (or host system) 110 may output various driving signals together with an image data signal received from the outside or an image data signal stored in an internal memory. The image supply 110 may transmit the data signal and the various driving signals to the timing controller 120.

The timing controller 120 may output a gate timing control signal GDC for controlling the operation timing of the scan driver 130, a data timing control signal DDC for controlling the operation timing of the data driver 140, and various synchronization signals (a vertical synchronization signal Vsync and a horizontal synchronization signal Hsync). The timing controller 120 may transmit a data signal DATA received from the image supply 110 together with the data timing control signal DDC to the data driver 140. The timing controller 120 may be configured in the form of an integrated circuit (IC) and mounted on a printed circuit board (PCB), which should not be construed as limiting the present invention.

The power supply 180 may convert power received from the outside to high-potential first power and low-potential second power and output the high-potential first power and the low-potential second power through a first power line EVDD and a second power line EVSS, under the control of the timing controller 120. The power supply 180 may generate and output a voltage (e.g., a gate voltage including a gate high voltage and a gate low voltage) required for driving the scan driver 130 or a voltage (e.g., a drain voltage including a drain voltage and a half drain voltage) required for driving the data driver 140.

The data driver 140 may sample and latch the data signal DATA in response to the data timing control signal DDC received from the timing controller 120, and convert a digital data signal to an analog data voltage based on a gamma reference voltage. The data driver 140 may supply the data voltage to the sub-pixels included in the display panel 150 through data lines DL1 to DLn. The data driver 140 may be configured in the form of an IC and mounted on the display panel 150 or the PCB, which should not be construed as limiting the present invention.

The display panel 150 may display an image in response to the driving signal including the scan signal and the data voltage, and the power. The sub-pixels of the display panel 150 directly emit light. The sub-pixels of the display panel 150 directly emit light. The display panel 150 may be manufactured based on a rigid or flexible substrate formed of a material such as glass, silicon, or polyimide. In addition, the sub-pixels that emit light may be red, green, and blue (RGB) sub-pixels or red, green, blue, and white (RGBW) sub-pixels, which form pixels.

For example, one sub-pixel SP may be connected to a first sensing line SIO1, a first data line DL1, a first scan line GL1, the first power line EVDD, and the second power line EVSS. The sub-pixel SP may include a switching transistor, a driving transistor, a capacitor, and an organic light emitting diode. The sub-pixel SP may include a circuit for compensating for deterioration of the organic light emitting diode and the driving transistor that applies a driving current to the organic light emitting diode, which will be described below.

The scan driver 130 may output a scan signal (or a scan voltage) in response to the gate timing control signal GDC received from the timing controller 120. The scan driver 130 may transmit the scan signal to the sub-pixels included in the display panel 150 through scan lines GL1 to GLm. The scan driver 130 may be configured in the form of an IC or may be formed directly on the display panel 150 in a GIP manner.

The GIP scan driver 130 may include a shift register 131 and a level shifter 135. The level shifter 135 may generate one or more of clock signals Clks and a start signal Vst based on signals received from the timing controller 120. The clock signals Clks may be generated with K different phases (K is an integer equal to or greater than 2) such as 2 phases, 4 phases, or 8 phases.

The shift register 131 may operate based on the signals Clk and Vst received from the level shifter 135 and output scan signals Scan[1] to Scan[m] to turn on or off thin-film transistors formed on the display panel 150. The shift register 131 may be formed in the form of a thin film on the display panel 150 in the GIP manner.

The shift register 131 may generally be disposed in a non-display area NA of the display panel 150. The GIP scan driver 130 may be disposed in left and right non-display areas NA as illustrated in FIG. 4A or in upper and lower non-display areas NA as illustrated in FIG. 4B.

Figure 4A:
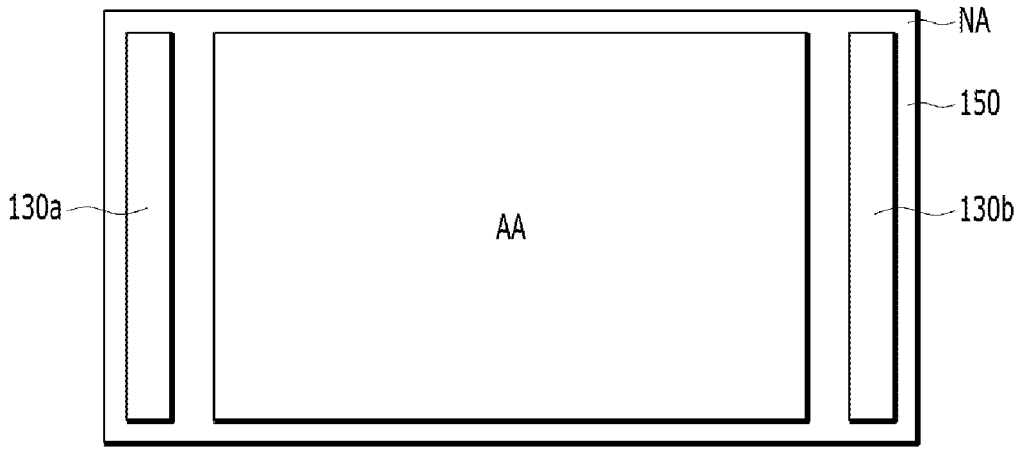
FIG. 4A and FIG. 4B are diagrams illustrating exemplary layouts of the GIP scan driver according to one embodiment.
Figure 4B:
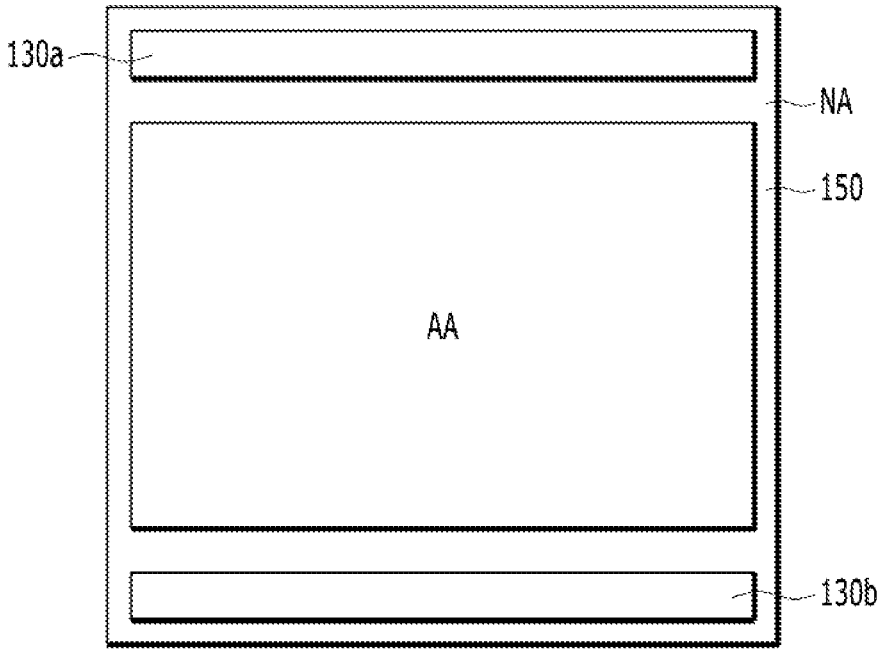

While a first GIP scan driver 130*a* and a second GIP scan driver 130*b* are shown in FIGS. 4A and 4B as arranged respectively in the left and right non-display areas NA or the upper and lower non-display areas NA of the display panel 150, the first GIP scan driver 130*a* and the second GIP scan driver 131*b* may be arranged only in one of the left, right, upper, and lower non-display areas NA of the display panel 150. Further, the GIP scan driver 130 may be disposed separately in a non-display area NA and a display area AA, or may be distributed in the display area AA.

Unlike the shift register 131, the level shifter 135 may be configured as an independent IC or included in the power supply 180. However, this configuration is merely an example, and various configurations are available, such as integration of one or more of the timing controller 120, the scan driver 130, and the data driver 140 into one IC.

Figure 5:
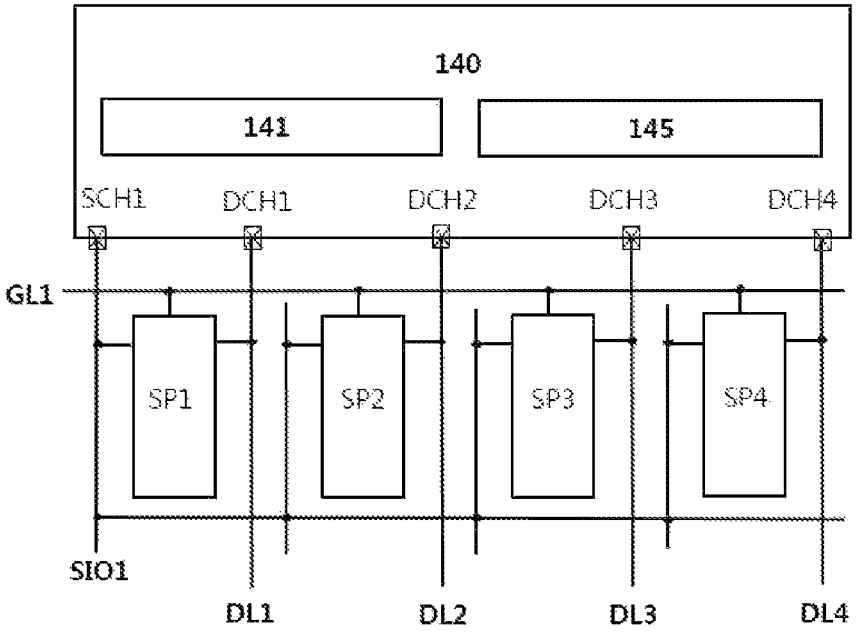
FIG. 5 is a diagram illustrating a data driver according to a first embodiment of the present disclosure.
Figure 6:
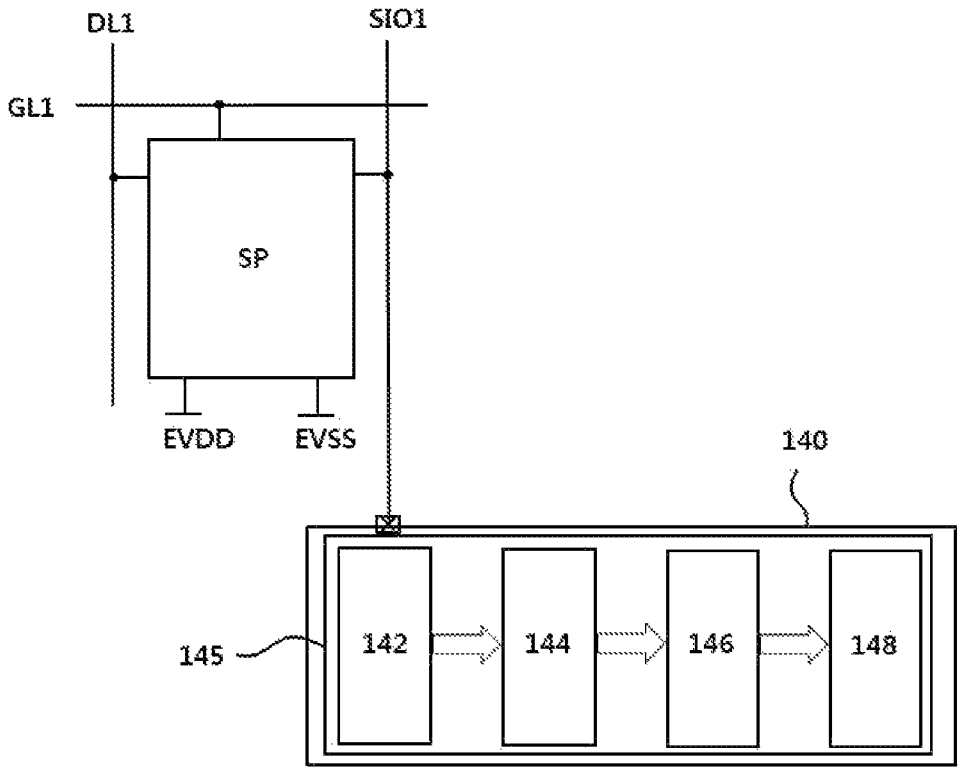
FIG. 6 is a diagram illustrating a sensing circuit according to the first embodiment of the present disclosure.
Figure 7:
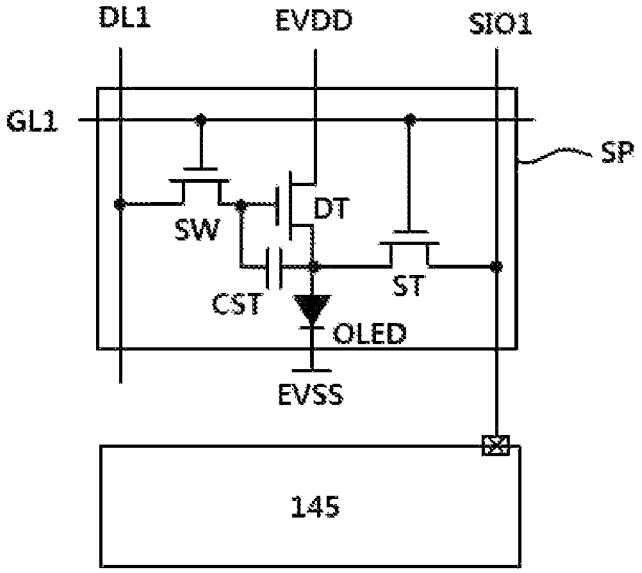
FIG. 7 is a diagram illustrating a sub-pixel according to the first embodiment of the present disclosure.

FIG. 5 is a diagram illustrating a data driver according to a first embodiment of the present disclosure, FIG. 6 is a diagram illustrating a sensing circuit according to the first embodiment of the present disclosure, and FIG. 7 is a diagram illustrating a sub-pixel according to the first embodiment of the present disclosure.

Referring to FIG. 5, the data driver 140 may include a driving circuit 141 for driving sub-pixels SP1 to SP4 and a sensing circuit 145 for sensing the sub-pixels SP1 to SP4. The driving circuit 141 may be connected to data channels DCH1 to DCH4 to supply a data voltage to the sub-pixels SP1 to SP4. The sensing circuit 145 may be connected to a sensing channel SCH1 to sense the sub-pixels SP1 to SP4.

The first to fourth data channels DCH1 to DCH4 may be connected respectively to first to fourth data lines DL1 to DL4. The first to fourth data lines DL1 to DL4 may be connected respectively to the first to fourth sub-pixels SP1 to SP4. The first sensing channel SCH1 may be connected to the first sensing line SIO1. The first sensing line SIO1 may be connected commonly to the first to fourth sub-pixels SP1 to SP4.

The light emitting display device is shown and described in FIG. 5 as implemented to share the first sensing line SIO1 among the four sub-pixels SP1 to SP4, by way of example, which should not be construed as limiting the present invention. In addition, while the sensing circuit 145 is described as being included in the data driver 140 with reference to FIG. 5, the sensing circuit 145 may be configured independently.

Referring to FIG. 6, the sensing circuit 145 included in the data driver 140 may include a switch circuit 142, a sample holder 144, a scaler 146, and an analog-to-digital (AD) converter 148.

The switch circuit 142 may output a reference voltage through the first sensing line SIO1 or perform a switching operation to sense a sub-pixel SP. The sample holder 144 may sample and hold a sensing voltage sensed from the sub-pixel SP. The scaler 146 may scale the sampled sensing voltage to a voltage range processible in the AD converter 148. The AD converter 148 may convert an analog sensing voltage to a digital sensing voltage.

FIG. 6 is merely an example taken for illustration and description to help understanding of devices that may be included in the sensing circuit 145 and their operations or functions, and thus does not limit the present invention. Further, the timing controller may receive the sensing voltage from the sensing circuit 145 and perform an operation of compensating for deterioration of the sub-pixel SP based on the sensing voltage.

Referring to FIG. 7, one sub-pixel SP may include a switching transistor SW, a driving transistor DT, a sensing transistor ST, a capacitor CST, and an organic light emitting diode OLED.

The driving transistor DT may have a gate electrode connected to a first electrode of the capacitor CST, a first electrode connected to the first power line EVDD, and a second electrode connected to an anode electrode of the organic light emitting diode OLED. The capacitor CST may have the first electrode connected to the gate electrode of the driving transistor DT and a second electrode connected to the anode electrode of the organic light emitting diode OLED. The organic light emitting diode OLED may have the anode electrode connected to the second electrode of the driving transistor DT, and a cathode electrode connected to the second power line EVSS.

The switching transistor SW may have a gate electrode connected to a first scan line GL1, a first electrode connected to a first data line DL1, and a second electrode connected to the gate electrode of the driving transistor DT. The sensing transistor ST may have a gate electrode connected to the first scan line GL1, a first electrode connected to the first sensing line SIO1, and a second electrode connected to the anode electrode of the organic light emitting diode OLED.

The sensing transistor ST is a type of compensation circuit added to compensate for deterioration (a threshold voltage or the like) of the driving transistor DT or the organic light emitting diode OLED. The sensing transistor ST may enable physical threshold voltage sensing based on a source follower operation of the driving transistor DT. The sensing transistor ST may operate to obtain a sensing voltage through a sensing node defined between the driving transistor DT and the organic light emitting diode OLED. The sensing voltage obtained from the sensing transistor ST may be transmitted to the sensing circuit 145 through the first sensing line SIO1.

FIG. 7 is merely an example taken for illustration and description to help understanding of circuits that may be included in a sub-pixel SP and their operations or functions, and thus does not limit the present disclosure. Further, one sub-pixel SP may be implemented to include P-type transistors instead of N-type transistors, and may further include a transistor that executes any other function.

For convenience, the following description is given in the context of the sub-pixel SP illustrated in FIG. 7.

Figure 8:
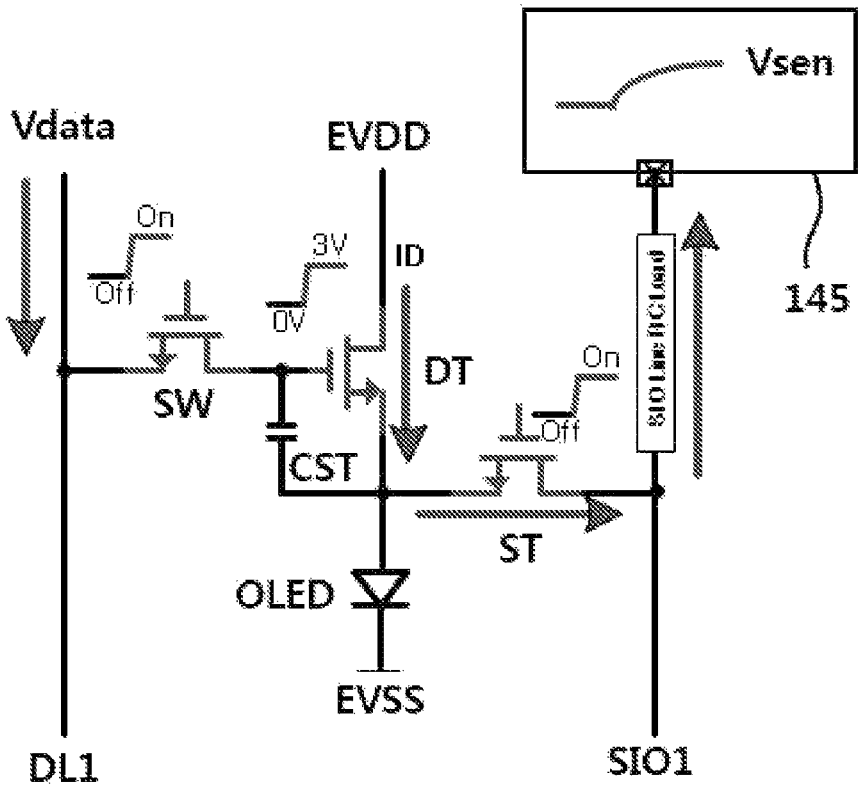
FIG. 8 is a diagram illustrating a process of obtaining a sensing voltage by using the sub-pixel illustrated in FIG. 7 according to one embodiment.
Figure 9:
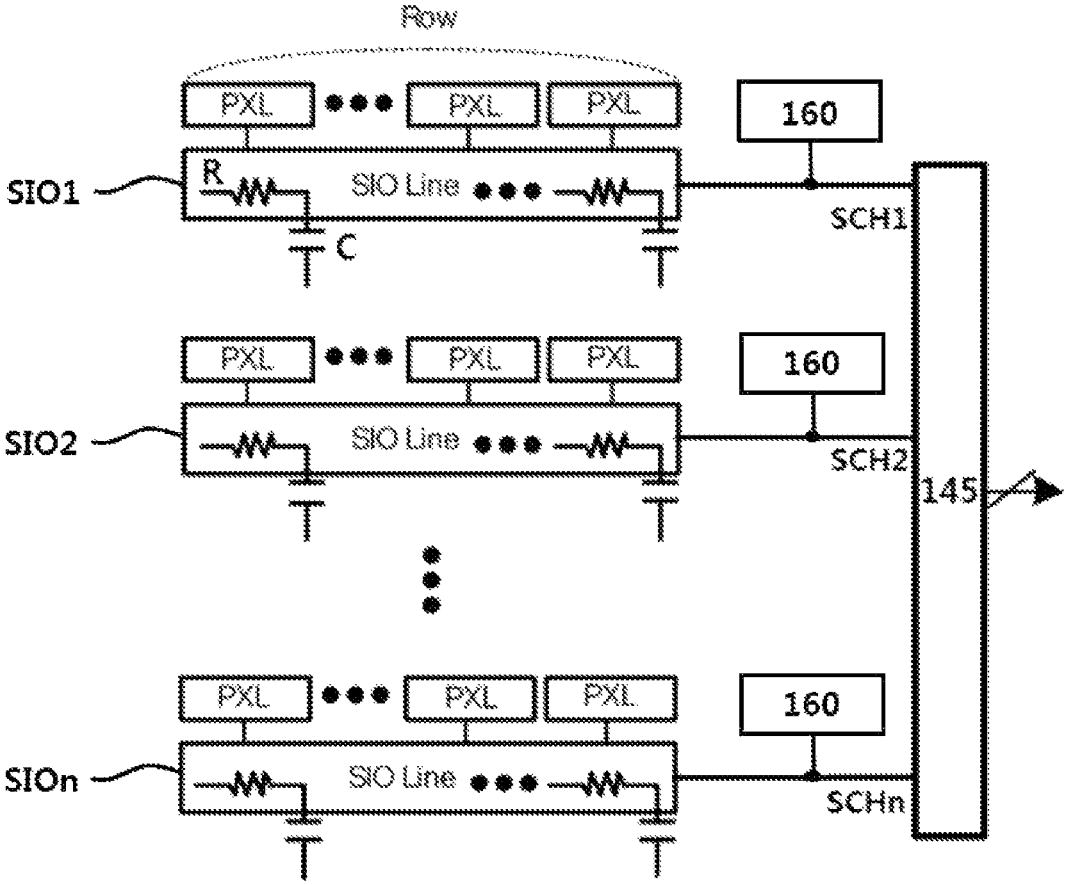
FIG. 9 is a diagram illustrating a function of a deviation calibrator according to the first embodiment of the present disclosure.

FIG. 8 is a diagram illustrating a process of obtaining a sensing voltage from the sub-pixel illustrated in FIG. 7, and FIG. 9 is a diagram illustrating a function of a deviation calibrator according to a first embodiment of the present disclosure.

Referring to FIG. 8, when the switching transistor SW is turned on and a sensing data voltage is applied to the capacitor CST, the driving transistor DT may operate as a source follower. When the driving transistor DT is then saturated, a sensing voltage Vsen charged in the source electrode of the driving transistor DT may be obtained through the sensing transistor ST.

Because the sensing transistor ST is connected between the source electrode of the driving transistor DT and the first sensing line SIO1, the sensing voltage Vsen obtained from the sensing transistor ST may correspond to a threshold voltage of the driving transistor DT.

To obtain the sensing voltage Vsen used to determine whether the driving transistor DT has been deteriorated in the above manner, the driving transistor DT may have to reach the saturation state. That is, when the driving transistor DT reaches the saturation state, the sensing voltage Vsen may be obtained. However, a long time may be taken for the driving transistor DT to reach the saturation state. Moreover, different impedance of each sensing line may cause a sensing deviation, which is overcome as follows in the present invention.

Referring to FIG. 9, a deviation calibrator 160 may be provided in the first embodiment of the present disclosure. The deviation calibrator 160 may be included in the data driver 140, for example. A deviation calibrator 160 may be disposed at each of the first sensing line SIO1 to an $n^{th}$ sensing line SIOn. The deviation calibrator 160 may improve (eliminate or mitigate) the impedance deviation of each of the first sensing line SIO1 to the $n^{th}$ sensing line SIOn and serve as a booster that increases the speed of obtaining a sensing voltage as well.

The deviation calibrator 160 may perform a calibration operation to improve an impedance deviation caused by the difference between a resistance value R and a capacitance value C of each of the first sensing line SIO1 to the $n^{th}$ sensing line SIOn. The deviation calibrator 160 may detect the capacitance value of each of the first sensing line SIO1 to the $n^{th}$ sensing line SIOn and cancel or reduce the capacitance value C by the calibration operation, thereby reducing RC load.

The deviation calibrator 160 performs calibration in a search method in which a pulsed voltage at a specific level is applied to each of the first sensing line SIO1 to the $n^{th}$ sensing line SIOn and then a target voltage value (impedance offset value) is detected. The pulsed voltage at the specific level may be applied from the inside of the data driver 140 including the deviation calibrator 160 or externally, for example, from the power supply.

The pulsed voltages may be set to voltage levels available to cancel the capacitance values C of the first sensing line SIO1 to the $n^{th}$ sensing line SIOn. One or more of the levels of the pulsed voltages may be different according to capacitance differences (or impedance differences) among the first sensing line SIO1 to the $n^{th}$ sensing line SIOn. The sensing circuit including the deviation calibrators 160 may perform the calibration operation in a flow illustrated in FIG. 10.

Figure 10:
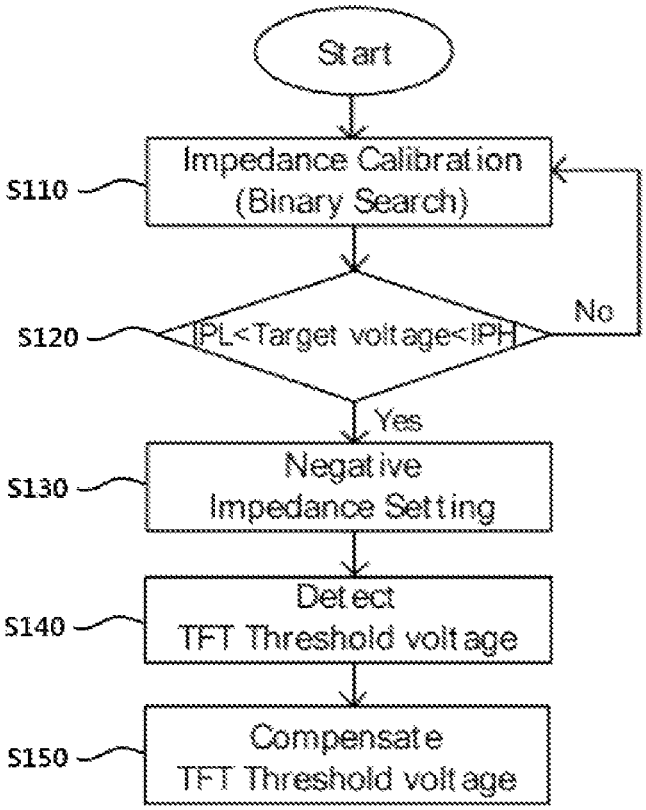
FIGS. 10 and 11 are diagrams illustrating a deviation calibration method according to the first embodiment of the present disclosure.
Figure 11:
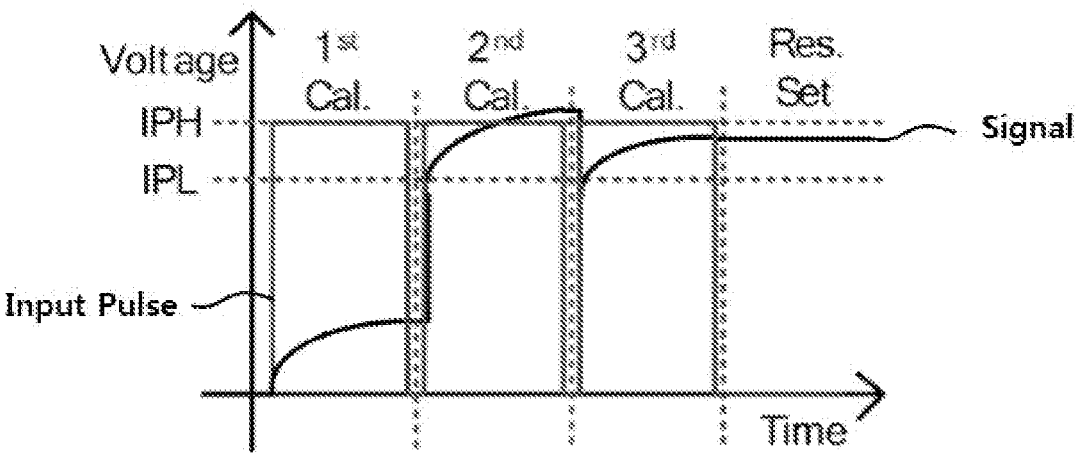

FIGS. 10 and 11 are diagrams illustrating a deviation calibration method according to the first embodiment of the present disclosure.

Referring to FIGS. 10 and 11, an impedance calibration operation may be performed in order to improve the impedance deviation of each sensing line (S110). The impedance calibration operation may be, but not limited to, a binary search method in which a process of discarding one part of two parts and searching the remaining part to detect a target voltage value is repeated. That is, the impedance deviation between the different sensing lines is determined.

According to the binary search method, a process of detecting a target voltage value between an input pulse low level voltage (IPL) and an input pulse high level voltage (IPH) may be repeatedly performed (S120). Therefore, when the target voltage value is detected (Yes), the procedure may proceed to the next step, and otherwise (No), the procedure may return to the previous step.

In the illustrated case of FIG. 11, when an input pulse of a specific level is applied to a sensing line, a calibration operation may be performed based on the binary search method to detect a target voltage value. FIG. 11 illustrates a case in which a signal corresponding to a target voltage value is detected through about three calibrations $1^{st}$ Cal. to $3^{rd}$ Cal. after a pulsed voltage at a specific level, Input Pulse is applied, which should not be construed as limiting the present disclosure.

When the target voltage value is detected (Yes), a negative impedance value may be set, with which the impedance difference of each sensing line may be canceled based on the target voltage value (S130). The negative impedance value may mean a value with which to cancel the target voltage, that is, a negative value (or offset value) that cancels the impedance deviation of each sensing line.

After all of the impedance deviations of the sensing lines are canceled with the negative impedance value, a sensing voltage may be obtained from each sensing line to detect the threshold voltage of the driving transistor (S140). A compensation operation for compensating the threshold voltage of the driving transistor may then be performed based on the sensing voltage (S150).

Figure 12:
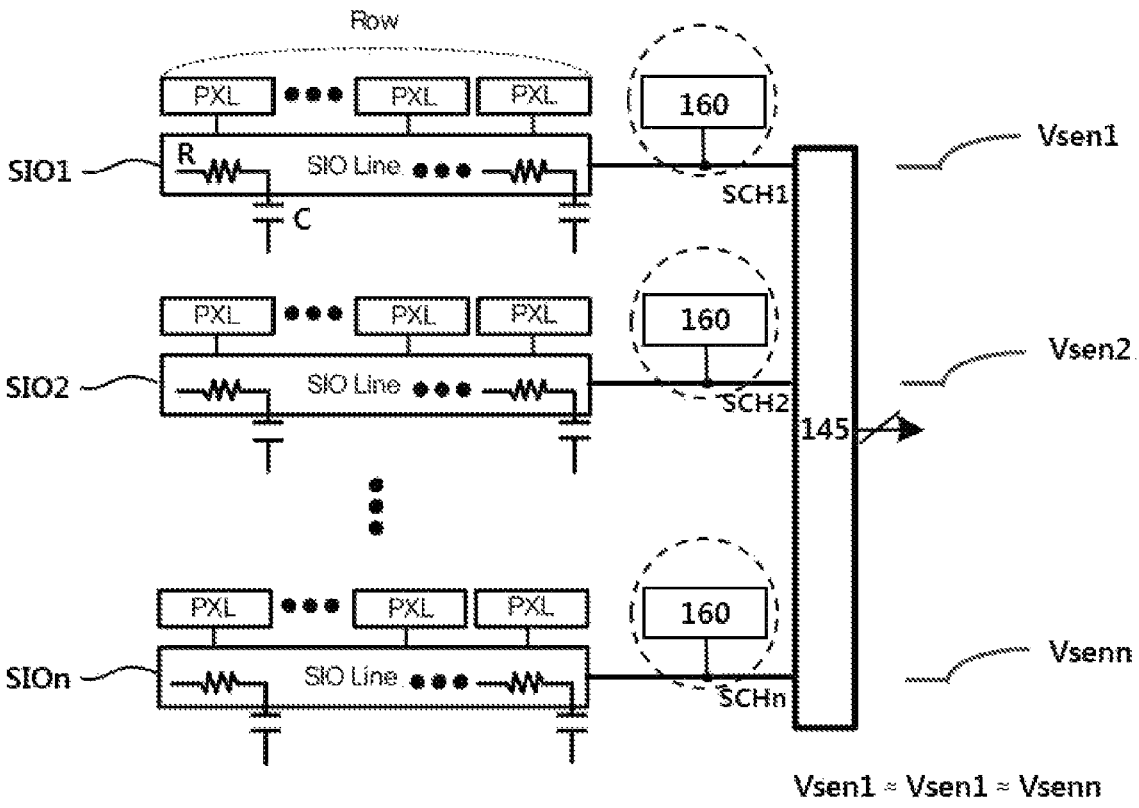
FIGS. 12 and 13 are diagrams illustrating the difference between use and non-use of a deviation calibrator.
Figure 13:
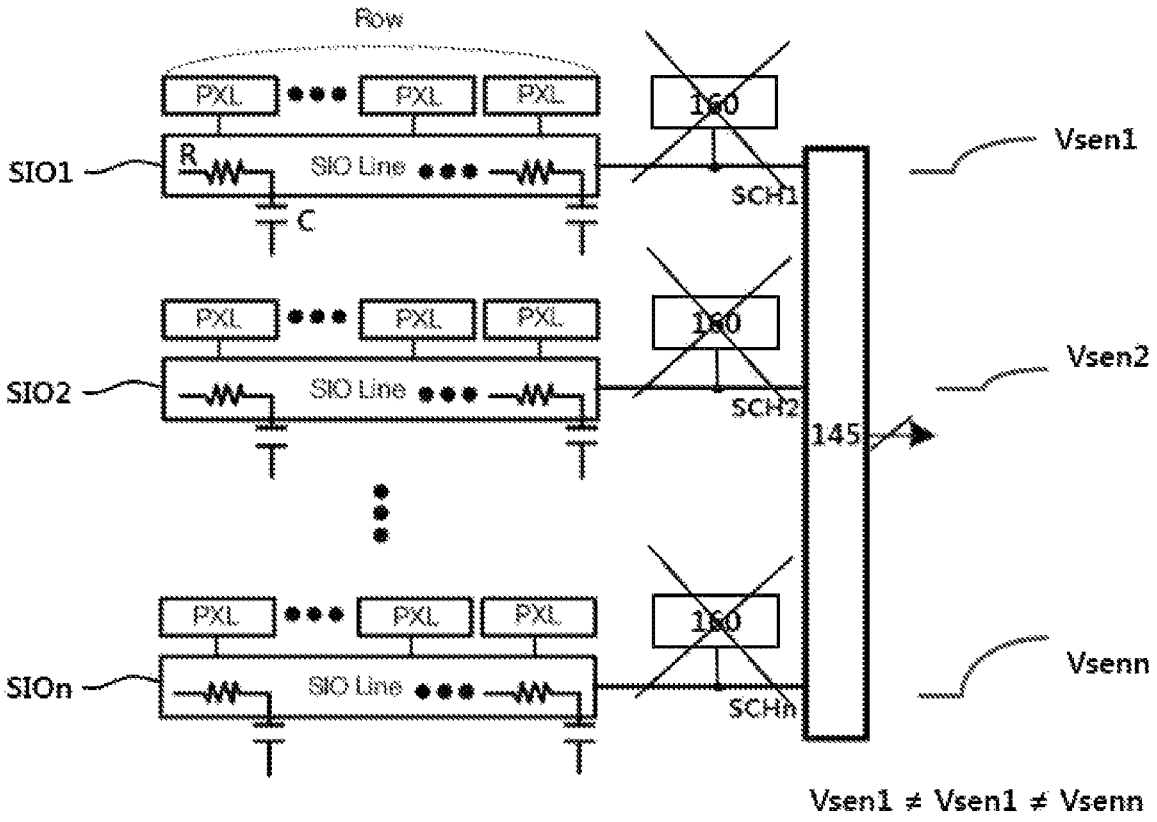

FIGS. 12 and 13 are diagrams referred to for describing the difference between use and non-use of the deviation calibrator. The example of FIGS. 12 and 13 is based on the assumption that the elements of sub-pixels are deteriorated to the same level or are placed in an initial state, in order to describe the difference between use and non-use of the deviation calibrator.

Referring to FIG. 12, after the impedance deviation of each sensing line is canceled by performing a calibration operation in the deviation calibrator 160, the first sensing lines SIO1 to the $n^{th}$ sensing lines SIOn are sensed. Then, sensing voltages Vsen1 to Vsenn obtained through the first sensing line SIO1 to the $N^{th}$ sensing line SIOn may be detected at an almost equal level, such as "Vsen1≈Vsen2≈Vsenn". This is because the sensing has been performed with the impedance deviation of each sensing line canceled.

Referring to FIG. 13, without the calibration operation of the deviation calibrators 160, the first sensing line SIO1 to the $n^{th}$ sensing line SIOn are sensed. Then, some or all of the sensing voltages Vsen1 to Vsenn obtained through the first sensing line SIO1 to the $n^{th}$ sensing line SIOn may be detected at different levels, such as "Vsen1≠Vsen2≠Vsenn". This is because the sensing has been performed with no impedance deviation of each sensing line canceled.

As noted from FIGS. 12 and 13, when the elements included in the sub-pixels are deteriorated to the same level or are in the initial state, the impedance deviation of each sensing line may be reduced or canceled to increase sensing accuracy.

Figure 14:
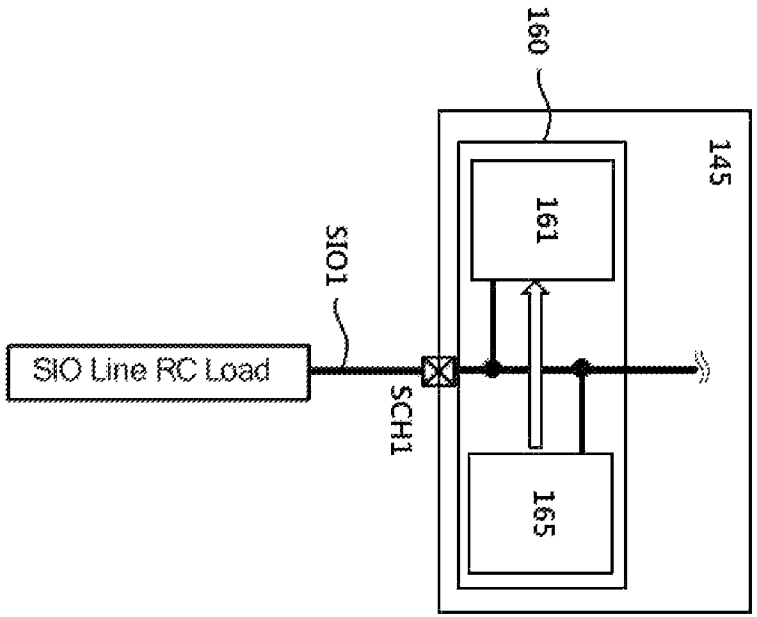
FIGS. 14 and 15 are diagrams illustrating the configuration of a deviation calibrator according to a second embodiment of the present disclosure.
Figure 15:
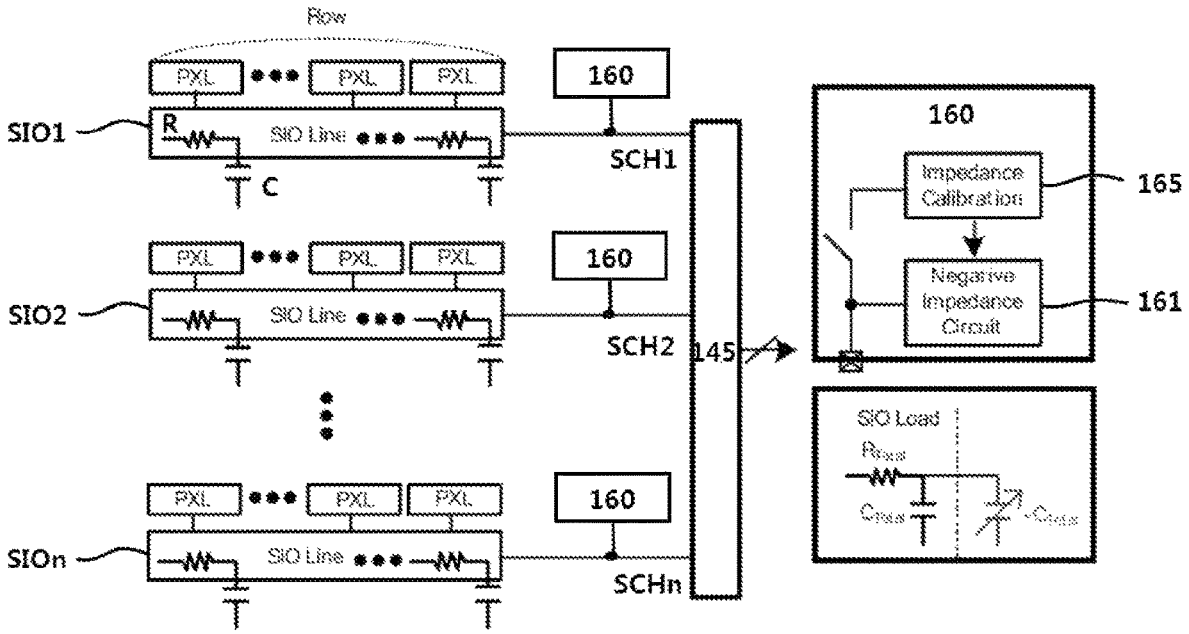
Figure 16:
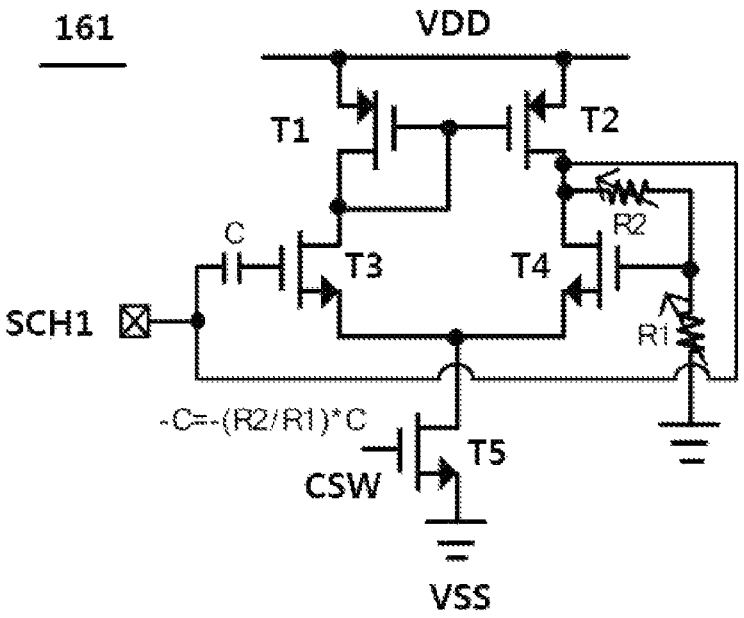
FIG. 16 is an exemplary circuit diagram illustrating a negative impedance generator illustrated in FIG. 15 according to the second embodiment of the present disclosure.

FIGS. 14 and 15 are diagrams illustrating the configuration of a deviation calibrator according to a second embodiment of the present disclosure, and FIG. 16 is an exemplary circuit diagram illustrating the configuration of a negative impedance generator illustrated in FIG. 15 according to the second embodiment.

Referring to FIG. 14, the deviation calibrator 160 according to the second embodiment of the present disclosure may be included in the sensing circuit 145 and connected to the first sensing line SIO1 through the first sensing channel SCH1. The deviation calibrator 160 may include a negative impedance generator 161 for generating a negative impedance value and an impedance calibrator 165 for controlling the negative impedance generator 161.

Referring to FIG. 15, the negative impedance generator 161 and the impedance calibrator 165 may operate in conjunction with each other to cancel an impedance deviation caused by the difference between a total resistance value $R_{Total}$ and a total capacitance value $C_{Total}$ of the SIO load of a sensing line based on a negative impedance value $-C_{Total}$.

Referring to FIG. 16, the negative impedance generator 161 may include a capacitor C, transistors T1 to T5, and variable resistors R1 and R2.

The capacitor C may have one end connected to the first sensing channel SCH1 and a second electrode of the second transistor T2, and the other end connected to a gate electrode of the third transistor T3. The first transistor T1 may have a gate electrode and a second electrode connected commonly to a first electrode of the third transistor T3, and a first electrode connected to a first voltage line VDD. The second transistor T2 may have a gate electrode connected to the first electrode of the third transistor T3, a first electrode connected to the first voltage line VDD, and a second electrode connected to a first electrode of the fourth transistor T4.

The third transistor T3 may have the gate electrode connected to the other end of the capacitor C, the first electrode connected to the gate electrode of the first transistor T1, and a second electrode connected to a second electrode of the fifth transistor T5. The fourth transistor T4 may have a gate electrode connected to one end of the first variable resistor R1, the first electrode connected to the second electrode of the second transistor T2 and one end of the second variable resistor R2, and a second electrode connected to a first electrode of the transistor T5. The fifth transistor T5 may have a gate electrode connected to a control line CSW, the first electrode connected to the second electrode of the third transistor T3 and the second electrode of the fourth transistor T4, and the second electrode connected to a second voltage line VSS.

The negative impedance generator 161 may generate a negative impedance value by changing the resistance value of at least one of the variable resistors R1 and R2 in response to a control signal applied through the control line CSW. A third embodiment will be described below by simplifying the circuit of the negative impedance generator 161.

Figure 17:
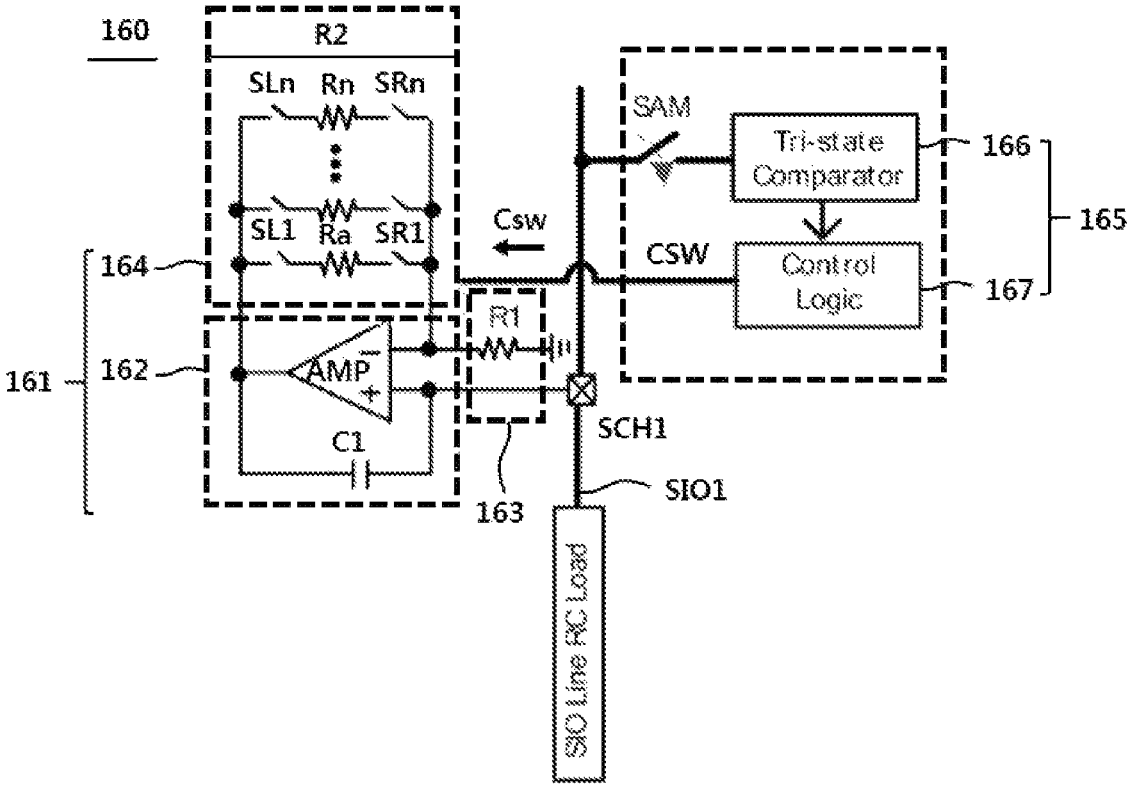
FIG. 17 is a detailed diagram illustrating the configuration of a deviation calibrator according to a third embodiment of the present disclosure.
Figure 18:
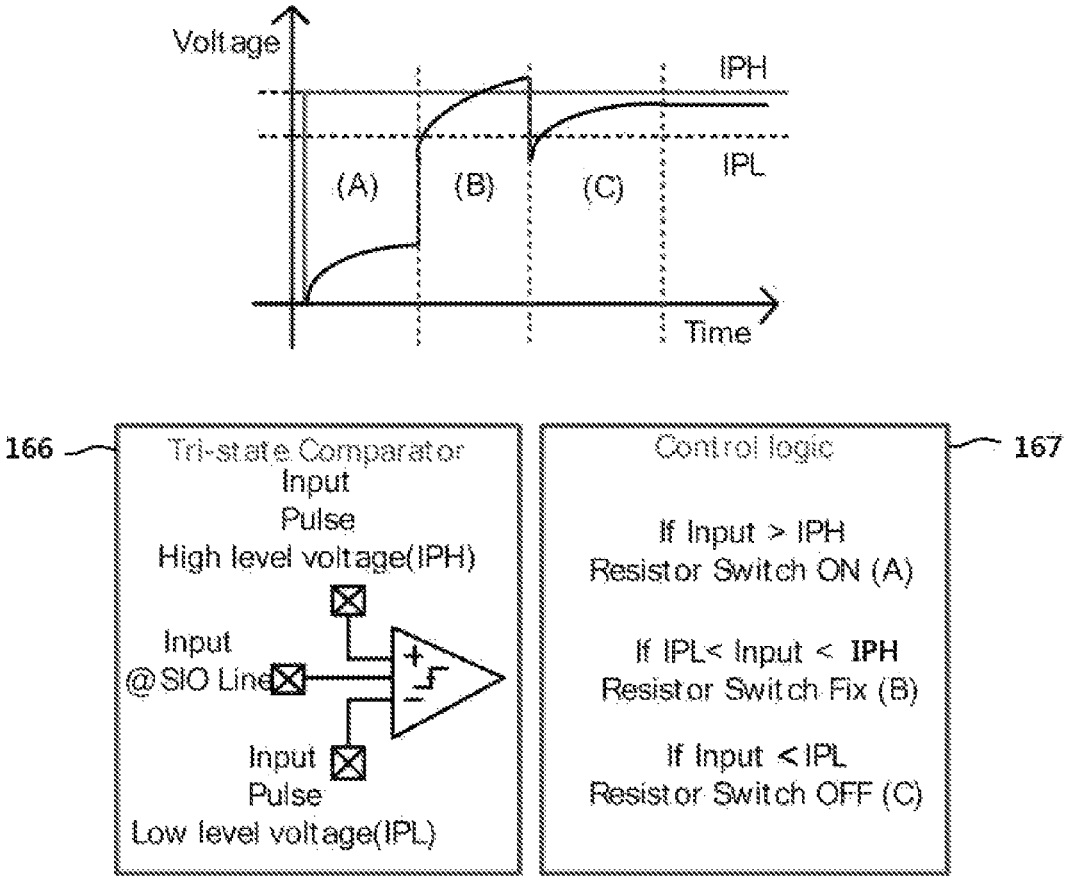
FIG. 18 is a diagram illustrating an exemplary operation of the deviation calibrator according to the third embodiment of the present disclosure.

FIG. 17 is a detailed diagram illustrating the configuration of a deviation calibrator according to the third embodiment of the present disclosure, and FIG. 18 is a diagram referred to for describing an exemplary operation of the deviation calibrator according to the third embodiment of the present disclosure.

Referring to FIG. 17, the deviation calibrator 160 according to the third embodiment of the present disclosure may include a negative impedance generator 161 connected to the first sensing channel SCH1 and an impedance calibrator 165 for controlling the negative impedance generator 161.

The negative impedance generator 161 may include a first circuit 162 including a capacitor C1 and an amplifier AMP, a second circuit 163 including a first resistor R1, and a third circuit 164 including second resistors Ra to Rn and switches SL1 to SLn and SR1 to SRn.

The amplifier AMP included in the first circuit 162 may have a non-inverting terminal + connected to the first sensing channel SCH1, an inverting terminal – connected to one end of the first resistor R1 included in the second circuit 163, and an output terminal connected commonly to first terminals of the switches SL1 to SLn included in the third circuit 164. The capacitor C1 included in the first circuit 162 may have one end connected to the first sensing channel SCH1 and the other end connected to the output terminal of the amplifier AMP.

The first resistor R1 included in the second circuit 163 may have the one end connected to the inverting terminal – of the amplifier AMP included in the first circuit 162 and the other end connected to the second voltage line.

The switches SL1 to SLn included in the third circuit 164 may have the first terminals connected commonly to the output terminal of the amplifier AMP included in the first circuit 162, and second terminals connected respectively to one ends of the second resistors Ra to Rn. The other switches SR1 to SRn included in the third circuit 164 may have first terminals connected commonly to the inverting terminal – of the amplifier AMP included in the first circuit 162, and second terminals connected respectively to the other ends of the second resistors Ra to Rn.

Third terminals (or control terminals) of the switches S11 to SLn and the other switches SR1 to SRn may be connected to the control signal line CSW. The switches SL1 to SLn and the other switches SR1 to SRn may be turned on or off under one or more different conditions in response to control signals Csw applied through the control signal line CSW. Accordingly, the resistance value of the third circuit 164 may vary according to the connection states of the switches SL1 to SLn and SR1 to SRn and the second resistors Ra to Rn. For convenience of description, the second resistors Ra to Rn will be referred to shortly as the second resistor R2.

The impedance calibrator 165 may include a sampling switch SAM, a tri-state comparator 166, and a controller 167.

The sampling switch SAM may have a first terminal connected to the first sensing channel SCH1, a second terminal connected to an input terminal of the three-state comparator 166, and a third terminal (or control terminal) connected to the control logic 167. The sampling switch SAM may perform a switching operation by turning on or off in response to one of the control signals Csw output from the control logic 167. When the sampling switch SAM is turned on, the sampling switch SAM may obtain a voltage value of the first sensing channel SCH1 and transmit the voltage value to the tri-state comparator 166.

The tri-state comparator 166 may compare the voltage value received from the sampling switch SAM, a high voltage value, and a low voltage value, and then output a result value. The control logic 167 may generate and output control signals Csw for controlling the negative impedance generator 161 based on the result value received from the tri-state comparator 166. The control logic 167 may output the control signals Csw through the control signal line CSW connected to the negative impedance generator 161.

Referring to FIGS. 17 and 18, the deviation calibrator 160 may perform impedance calibration during a turn-off period of the light emitting display device. Pulsed voltages IPH and IPL of specific levels may be applied for the calibration operation of the deviation calibrator 160.

The high voltage value IPH of the pulse voltages IPH and IPL may be applied to the first terminal + of the tri-state comparator 166, and the low voltage value IPL may be applied to the second terminal – of the tri-state comparator 166. The voltage value (Input@SIO Line) Input received from the sampling switch SAM may be applied to the third terminal between the first terminal + and the second terminal – of the tri-state comparator 166.

When the voltage value Input applied through the third terminal of the tri-state comparator 166 is greater than the high voltage value IPH, the controller 167 may generate and output control signals Csw to turn on switches related to the second resistor R2. As illustrated in FIG. 17, since the resistors Ra to Rn are connected in parallel in the second resistor R2, the resistance value of the second resistor R2 may be lowered according to the number of turned-on switches among the switches SL1 to SLn and SR1 to SRn.

When the voltage value Input applied through the third terminal of the tri-state comparator 166 is greater than the low voltage value IPL and less than the high voltage value IPH, the controller 167 may generate and output control signals Csw that may fix switches related to the second resistor R2 to maintain the resistance value of the negative impedance generator 161. When it is said that the resistance value of the negative impedance generator 161 is maintained, this may imply that a target voltage value (impedance offset) has been detected.

When the voltage value Input applied through the third terminal of the tri-state comparator 166 is less than the low voltage value IPL, the controller 167 may generate and output control signals Csw that may turn off switches related to the second resistor R2 to increase the resistance value of the negative impedance generator 161. As illustrated in FIG. 17, since the resistors Ra to Rn are connected in parallel in the second resistor R2, the resistance value of the resistor R2 may be increased according to the number of turned-off switches among the switches SL1 to SLn and SR1 to SRn.

Therefore, according to the present invention, as the resistance value is changed by the operation of the devices included in the negative impedance generator 161, a negative impedance value that cancels the impedance deviation of the first sensing line SIO1 connected to the first sensing channel SCH1 (with respect to the impedance of another sensing line) may be generated. The impedance calibrator 165 may change the resistance value of the second resistor R2 included in the negative impedance generator 161 so that the resistance value may fall within 99% of a target voltage value (impedance offset) based on the tri-state comparator 166 included in the controller 167.

As such, the deviation calibrator 160 may detect an optimum resistance ratio to cancel the capacitance value of the display panel in the above process. The optimum resistance ratio detected in the above process may be applied to a sensing channel which has been subjected to impedance calibration during a sensing operation to compensate the threshold voltage of the driving transistor in real time. For every sensing channel for which a sensing operation is performed to compensate the threshold voltage of the driving transistor in real time, the process of detecting an optimum resistance ratio may be performed and the optimum resistance ratio may be applied.

When a negative impedance value is generated and the impedance deviation of each sensing line is canceled in the above process, and the next sensing operation is performed, the threshold voltage of the driving transistor may be detected fast. A cause of the fast threshold voltage detection will be described below.

Figure 19:
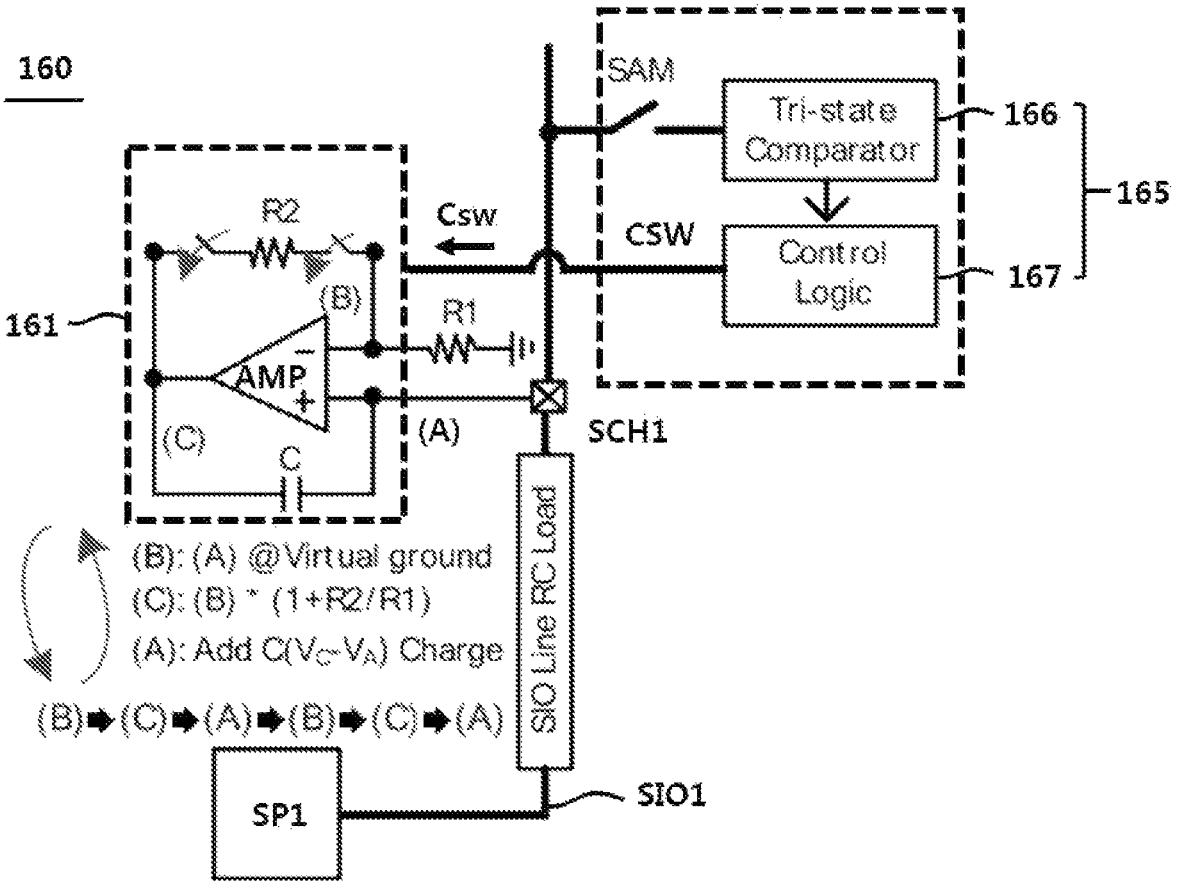
FIGS. 19 and 20 are diagrams referred to for describing a cause of fast sensing of a threshold voltage after calibration according to one embodiment.
Figure 20:
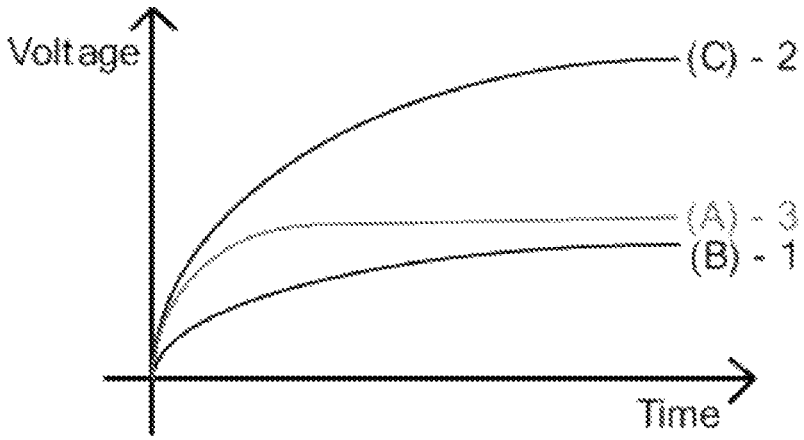
Figure 21:
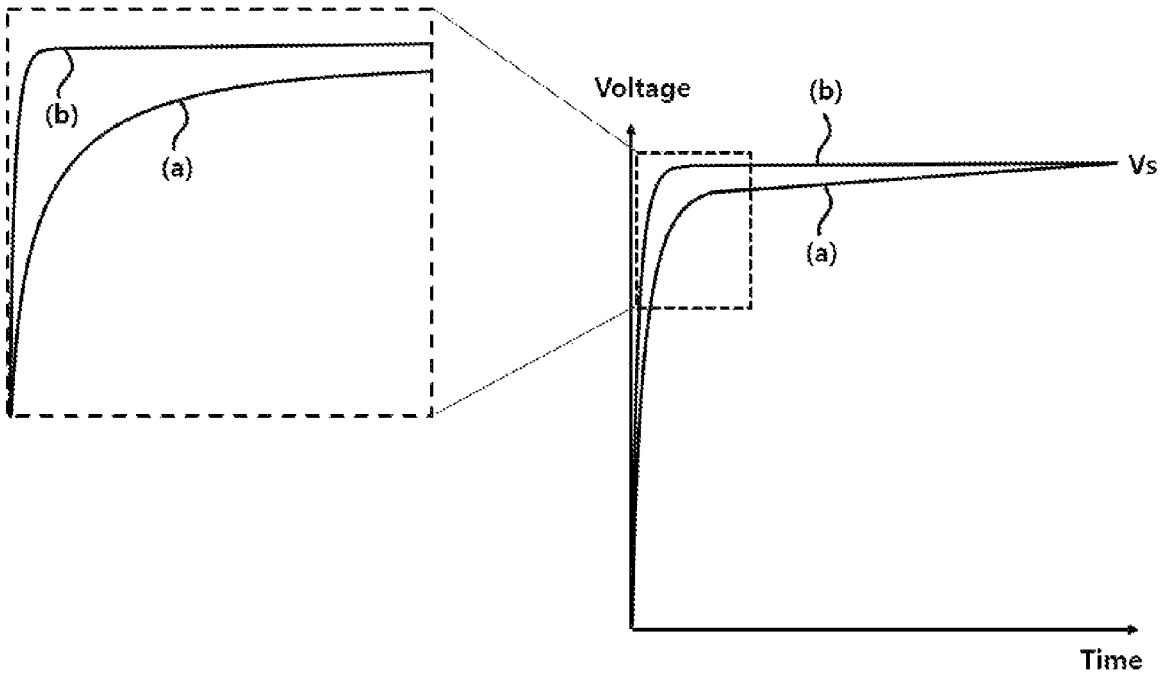
FIG. 21 is a diagram illustrating simulation results of use and non-use of a deviation calibrator according to the present disclosure.

FIGS. 19 and 20 are diagrams referred to for describing a cause of fast sensing of a threshold voltage after calibration, and FIG. 21 is a diagram illustrating simulation results of use and non-use of a deviation calibrator according to the present disclosure.

Referring to FIGS. 19 and 20, after the resistance value of the second resistor R2 included in the negative impedance generator 161 is set to a specific value through the calibration process, the threshold voltage of the driving transistor included in the first sub-pixel SP1 may be sensed through the first sensing line SIO1 connected to the first sensing channel SCH1.

In this process, voltage changes may occur to nodes in the order of (B), (C), and (A) in the negative impedance generator 161. It may be noted that the voltage value of node (B) increases slowly because node (A) serves as a virtual ground, as indicated by "(A) @Virtual ground". Then, the variation of the resistance value is reflected in node (C) as indicated by "(B)*(1+R2/R1)". Then, as the increment of node (C) is transferred to node (A), node (A) is power-boosted, as indicated by "Add $C(V_C-V_A)$ Charge".

Curve (a) in FIG. 21 illustrates a curve representing a sensing voltage Vs sensed from a specific sub-pixel during a sensing operation performed for real-time compensation of the threshold voltage of a driving transistor, when the deviation calibrator according to the present invention is turned off (not in use).

Curve (b) in FIG. 21 illustrates a curve representing a sensing voltage Vs sensed from the specific sub-pixel during the sensing operation for real-time compensation of the threshold voltage of the driving transistor, when the deviation calibrator according to the present disclosure is turned on (in use).

As noted from FIG. 21, when the deviation calibrator according to the present disclosure is used, the impedance deviation of a sensing line may be canceled, and thus the threshold voltage of the driving transistor may be detected and compensated quickly. This is because the variation of a capacitance value caused by element deterioration may be pre-reflected and pre-compensated for in an impedance calibration process, and a power boosting condition may be satisfied for the sensing line as well.

As is apparent from the foregoing description, the present disclosure may detect the capacitance value of each sensing line and cancel the capacitance difference of the sensing line. Further, the present invention may overcome the problem that much time is taken to detect the threshold voltage of a driving transistor due to the RC load of the sensing line. That is, according to the present disclosure, the threshold voltage of the driving transistor may be detected within a short period of time (approximately 110 times faster in a simulation).

Further, because the deviations and variations of sensing lines may be compensated for by impedance calibration in each turn-off period of the light emitting display device, the present invention may increase sensing accuracy. Further, a sensing voltage may be detected fast, and the resulting compensation of the threshold voltage of the driving transistor even during operation of the display panel may further increase the performance and lifetime of the display panel.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A light emitting display device comprising:

a display panel configured to display an image, the display panel including sensing lines;

a data driver configured to supply a data voltage to data lines of the display panel; and a sensing circuit configured to obtain a sensing voltage through the sensing lines of the display panel after reflecting a negative impedance value on the sensing lines, the negative impedance value canceling impedance differences between the sensing lines.

2. The light emitting display device according to claim 1, wherein the sensing circuit comprises:

a plurality of negative impedance generators, each negative impedance generator disposed at a corresponding sensing line from the sensing lines and configured to generate the negative impedance value for the corresponding sensing line; and a plurality of impedance calibrators coupled to one of the plurality of negative impedance generators, each impedance calibrator configured to control the negative impedance generator coupled to the impedance calibrator.

3. The light emitting display device according to claim 2, wherein at least one of the negative impedance generators is configured to generate the negative impedance value by changing a resistance value of the sensing line.

4. The light emitting display device according to claim 3, wherein the resistance value is changed according to connection states of switches and resistors operating in response to a control signal output from the impedance calibrator.

5. The light emitting display device according to claim 3, wherein at least one of the impedance calibrator comprises:

a sampling switch configured to perform a switching operation to obtain a voltage value of a sensing channel connected to the sensing line;

a tri-state comparator configured to compare the voltage value received from the sampling switch, a high voltage value, and a low voltage value, and output a result value; and a controller configured to control the negative impedance generator based on the result value received from the tri-state comparator.

6. The light emitting display device according to claim 5, wherein responsive to the voltage value received by the tri-state comparator is greater than the high voltage value, the controller is configured to output a control signal to reduce a resistance value of the negative impedance generator.

7. The light emitting display device according to claim 5, wherein responsive to the voltage value received by the tri-state comparator is greater than the low voltage value and less than the high voltage value, the controller is configured to output a control signal to maintain a resistance value of the negative impedance generator.

8. The light emitting display device according to claim 5, wherein responsive to the voltage value received by the tri-state comparator is less than the low voltage value, the controller is configured to output a control signal to increase a resistance value of the negative impedance generator.

9. A method of driving a light emitting display device comprising:

applying one or more different pulsed voltages to sensing lines of a display panel included in the light emitting display device;

determining impedance deviation between the sensing lines based on the application of the one or more different pulsed voltages to the sensing lines;

generating a negative impedance value that cancels the impedance deviation between the sensing lines of the display panel;

applying the negative impedance value to the sensing lines;

obtaining a sensed threshold voltage of a driving transistor of the display panel through one of the sensing lines after applying the negative impedance value to the sensing lines; and compensating the threshold voltage of the driving transistor based on the sensed threshold voltage.

10. The method according to claim 9, wherein applying the negative impedance value to the sensing lines changes a resistance value of each sensing line.

11. The method according to claim 9, wherein determining the impedance deviation comprises obtaining a voltage of a sensing channel connected to each of the sensing lines, comparing the voltage value, a high voltage value, and a low voltage value, and the impedance deviation is determined based on the comparison, wherein the negative impedance value applied to the sensing lines cancels the impedance deviation of the sensing lines by changing a resistance value of a negative impedance generator.

12. The method according to claim 9, wherein the negative impedance value is different between at least two of the sensing lines.

13. A light emitting display device comprising:

a display panel including a plurality of pixels, a plurality of sensing lines, and a plurality of data lines, each of the plurality of sensing lines and each of the plurality of data lines connected to a corresponding one of the plurality of pixels;

a data driver configured to supply data voltages to the plurality of pixels, each of the data voltages supplied to a corresponding one of the plurality of pixels via one of the plurality of data lines that is connected to the corresponding one of the plurality of pixels; and a deviation calibrator configured to determine impedance differences between the plurality of sensing lines and generate negative impedance values for the plurality of sensing lines based on the determined impedance differences, wherein resistances of the plurality of sensing lines are changed based on the negative impedance values to cancel the impedance differences between the plurality of sensing lines.

14. The light emitting display device of claim 13, further comprising:

a sensing circuit configured to sense a threshold voltage of a transistor included in at least one of the plurality of pixels after the resistances of the plurality of sensing lines are changed.

15. The light emitting display device of claim 13, wherein the deviation calibrator comprises a plurality of deviation calibrator circuits, each deviation calibrator circuit coupled to a corresponding one of the plurality of sensing lines.

16. The light emitting display device of claim 15, wherein at least one of the plurality of deviation calibrator circuits comprises:

a negative impedance generator configured to generate the negative impedance value for a sensing line from the plurality of sensing lines, the sensing line connected to the at least one of the plurality of deviation calibrator circuits; and an impedance calibrator coupled to the negative impedance generator, the impedance calibrator configured to change the negative impedance value generated by the negative impedance generator.

17. The light emitting display device of claim 13, wherein the negative impedance generator comprises a plurality of resistors connected in parallel and a plurality of switches connected to the plurality of resistors, each of the plurality of switches configured to connect or disconnect a corresponding one of the plurality of resistors to the impedance calibrator, wherein a resistance of the sensing line is changed based on a connection state of the plurality of switches and the impedance calibrator.

18. The light emitting display device of claim 17, wherein the impedance calibrator comprises:

a sampling switch configured to perform a switching operation to obtain a voltage value of a sensing channel connected to the sensing line;

a tri-state comparator configured to compare the voltage value received from the sampling switch, a high voltage value, and a low voltage value, and output a result value; and a controller configured to control the negative impedance generator based on the result value received from the tri-state comparator.

19. The light emitting display device of claim 18, wherein responsive to the voltage value received by the tri-state comparator is greater than the high voltage value, the controller is configured to output a control signal to reduce a resistance value of the negative impedance generator, wherein responsive to the voltage value received by the tri-state comparator is greater than the low voltage value and less than the high voltage value, the controller is configured to output a control signal to maintain a resistance value of the negative impedance generator, and wherein responsive to the voltage value received by the tri-state comparator is less than the low voltage value, the controller is configured to output a control signal to increase a resistance value of the negative impedance generator.

20. The light emitting display device of claim 14, wherein the deviation calibrator is included in the data driver or the sensing circuit.

* * * * *